US008221677B2

(12) United States Patent
Colavito et al.

(10) Patent No.: US 8,221,677 B2
(45) Date of Patent: Jul. 17, 2012

(54) WIRE INJECTION LANCE NOZZLE INSERT

(75) Inventors: Dominick M. Colavito, Bangor, PA (US); John Damiano, Easton, PA (US); Yves C. Vermeulen, Pen Argyl, PA (US)

(73) Assignee: Specialty Minerals (Michigan) Inc., Bingham Farms, MI (US)

( * ) Notice: Subject to any disclaimer, the term of this patent is extended or adjusted under 35 U.S.C. 154(b) by 23 days.

(21) Appl. No.: 11/731,969

(22) Filed: Apr. 2, 2007

(65) Prior Publication Data

US 2008/0236778 A1 Oct. 2, 2008

(51) Int. Cl.
*C21C 7/00* (2006.01)

(52) U.S. Cl. ..... 266/216; 266/225; 266/286

(58) Field of Classification Search ..... 266/216, 266/225, 286
See application file for complete search history.

(56) References Cited

U.S. PATENT DOCUMENTS

| | | | | |
|---|---|---|---|---|
| 4,481,032 | A | 11/1984 | Kaiser | |
| 4,512,800 | A | 4/1985 | Wirth, Jr. | |
| 4,630,802 | A * | 12/1986 | Frykendahl | 266/216 |
| 4,705,261 | A | 11/1987 | Wirth, Jr. | |
| 4,888,313 | A | 12/1989 | Adams et al. | |
| 4,895,713 | A | 1/1990 | Greinke et al. | |
| 5,505,348 | A * | 4/1996 | Muroi et al. | 222/606 |
| 2005/0110202 | A1 * | 5/2005 | Barrett et al. | 266/225 |

FOREIGN PATENT DOCUMENTS

| | | | |
|---|---|---|---|
| EP | 0137618 | A2 | 4/1985 |
| JP | 57007367 | A * | 1/1982 |

OTHER PUBLICATIONS

International Search Report dated Jul. 9, 2008 for PCT Application No. PCT/US08/04222.

Supplementary European Search Report dated Sep. 7, 2010 for counterpart EP Application No. 08742442.0.

* cited by examiner

*Primary Examiner* — Scott Kastler
(74) *Attorney, Agent, or Firm* — Derek S. Jessen; Leon Nigohosian, Jr.

(57) ABSTRACT

A lance nozzle insert for a refractory lance for feeding an additive wire into a quantity of molten metal below the surface of the molten metal surface is made of a material comprising stabilized zirconium oxide and graphite substantially increasing the corrosion resistance of the lance nozzle insert.

11 Claims, 5 Drawing Sheets

WIRE INJECTION LANCE NOZZLE INSERT

FIELD OF THE INVENTION

The present invention relates to methods and apparatus for metal production.

BACKGROUND

In the production of steel, a ferrous melt is typically produced in a suitable furnace and then tapped into a ladle where it is treated with one or more ingredients for refining or alloying purposes. It is well known to add calcium to the molten ferrous material at this point as a refining agent for oxide inclusion flotation, oxide inclusion morphology modification, desulfurization, etc. Unfortunately, the low density (relative to steel), volatility and reactivity of calcium severely complicate the task of providing a satisfactory process for its addition to the molten material in the ladle.

A variety of techniques have been employed for the addition of calcium to the molten material in a steelmaking ladle. Bulk addition of calcium-containing particulate materials is unsatisfactory because these materials rapidly rise to the surface of the melt without spending a sufficient residence time therein. Efforts to increase residence time by pouring the particulate material directly into the tapping stream from the furnace give rise to excessive reaction of the calcium with atmospheric oxygen. Introductions of calcium-containing materials by plunging or the injection of clad projectiles into the melt generally provide adequate residence times but are complicated, expensive and time-consuming procedures. It has also been proposed to inject calcium-containing powders into a melt by inert gas injection through a refractory lance. Since sizable flows of gas are required to propel the powder into the molten ferrous material, a high level of turbulence is generated at the surface of the melt as the gas is released, thereby causing an excessive exposure of the molten ferrous material to oxygen and nitrogen in the atmosphere. Furthermore, after leaving the lance, the calcium tends to rise rapidly through the melt in the inert gas plume surrounding the lance or in upwelling molten material adjacent the plume. Thus, calcium residence time in the bath is unacceptably low.

In an attempt to overcome the above-mentioned problems, calcium has also been added to melts in steelmaking ladles in the form of a calcium metal-containing wire (clad or unclad) continuously fed through the upper surface of the melt. A major advantage of wire feeding is that large flows of gas are not needed, as in powder injection, to propel the calcium-containing material into the molten ferrous material. However, the high volatility of calcium hinders the attainment of an efficient utilization of the calcium added in surface wire feeding. If the wire does not penetrate to a sufficient depth below the surface before the calcium in the wire desolidifies, a low residence time and poor recovery of the calcium results along with a non-uniform treatment of the melt. It is particularly important that most or all of the input calcium remain unreacted until it descends below the depth at which the ferrostatic pressure is equal to the vapor pressure of calcium. This goal is difficult to achieve, even when a clad calcium metal-containing wire is employed. When calcium desolidifies at ferrostatic pressures lower than its vapor pressure, large calcium gas bubbles are formed that rise rapidly to the surface of the melt. The result is an inefficient, non-uniform treatment of the molten ferrous material and the generation of a large amount of turbulence at the surface of the melt.

U.S. Pat. No. 4,512,800, assigned to the applicant, discloses an apparatus and method for treating molten ferrous material with processing additives in wire form such as calcium containing wires directly into a quantity of molten material using a heat-resistant lance having an outlet disposable beneath the surface of the molten material. In such a lance apparatus, the wire is fed into a passage going through the lance and an inert gas is concurrently injected into the passage together with the wire to prevent clogging of the lance by solidification of molten material while agitating the molten material by gas bubble agitation.

The use of the lance allows the calcium wire to melt and react with the molten ferrous material at a depth below the surface of the molten bath at which the ferrostatic pressure is greater than the vapor pressure of calcium at the temperature of the molten ferrous material. Because of the buoyancy of the wire, resulting from its lower density than that of the melt, the calcium wire bends.

The desolidification of calcium at a ferrostatic pressure greater than its vapor pressure leads to the creation by melting of liquid calcium globules, which rise much more slowly through the melt (thus providing a much higher residence time) than do calcium gas bubbles. As these liquid globules slowly rise through the molten ferrous material, those that do not react with inclusions are eventually transformed into a very large number of small gas bubbles that do not generate excessive turbulence when they reach the surface of the melt. Furthermore, the lance is generally positioned such that these liquid calcium globules rise through a region of downwelling of the ferrous molten material to promote efficient utilization of the calcium additive.

SUMMARY

According to an embodiment, a lance nozzle insert for a refractory lance for feeding an additive wire into a quantity of molten metal below the surface of the molten metal surface is disclosed. The lance nozzle insert comprises an inlet and an outlet, a passage provided between the inlet and the outlet for the additive wire being fed through the lance. The lance nozzle insert is made of a material comprising stabilized zirconium oxide, graphite and resin. The graphite can be natural graphite or synthetic graphite but natural flake graphite is preferred.

According to another embodiment, a lance for feeding or injecting an additive wire into a quantity of molten metal below the molten metal surface is disclosed. The lance comprises a refractory casing having a conduit providing a passage therein for conveying the wire to an outlet through which the wire exits the lance. The outlet is provided at the end of the lance that gets immersed below the surface of the molten metal. A lance nozzle insert is provided within the refractory casing in communication with the conduit and forming the outlet. The lance nozzle insert is made of a material comprising stabilized zirconium oxide, graphite and resin. The graphite can be natural graphite or synthetic graphite but natural flake graphite is preferred.

Because the nozzle tip end of the lance is immersed in the molten metal for a substantial length of time while the molten metal is being treated, the lance nozzle insert is exposed to the harsh conditions imposed by the molten metal. The stabilized zirconium oxide and graphite composition provide much better temperature and corrosion resistance than pure carbon that is currently used in lance injection and improves the durability of the lance nozzle insert in this harsh environment. The result is that the lance nozzle insert of the present invention has substantially longer operational life than the conventional lance nozzle inserts.

The refractory casing of the lance can be formed in two pieces, a main portion and a lance tip portion. In that configuration, the main portion contains a main portion of the conduit and the lance tip portion contains a second portion of the conduit and the lance nozzle insert. The main portion and the second portion of the conduit are configured and adapted to removably engage one another so that the lance tip portion can be removed from the main portion of the lance if necessary. This would allow the lance tip portion to be replaced with a new one should the lance nozzle insert become too worn out either from the corrosive effects of the molten metal environment or the mechanical wear from the additive wire passing through the lance nozzle insert.

The various embodiments of the invention will be described with the aid of the following drawings, in which, like reference numbers represent like elements.

All drawings are schematic illustrations and the structures rendered therein are not intended to be in scale. It should be understood that the invention is not limited to the precise arrangements and instrumentalities shown, but is limited only by the scope of the claims.

DETAILED DESCRIPTION OF THE INVENTION

Figure 1:
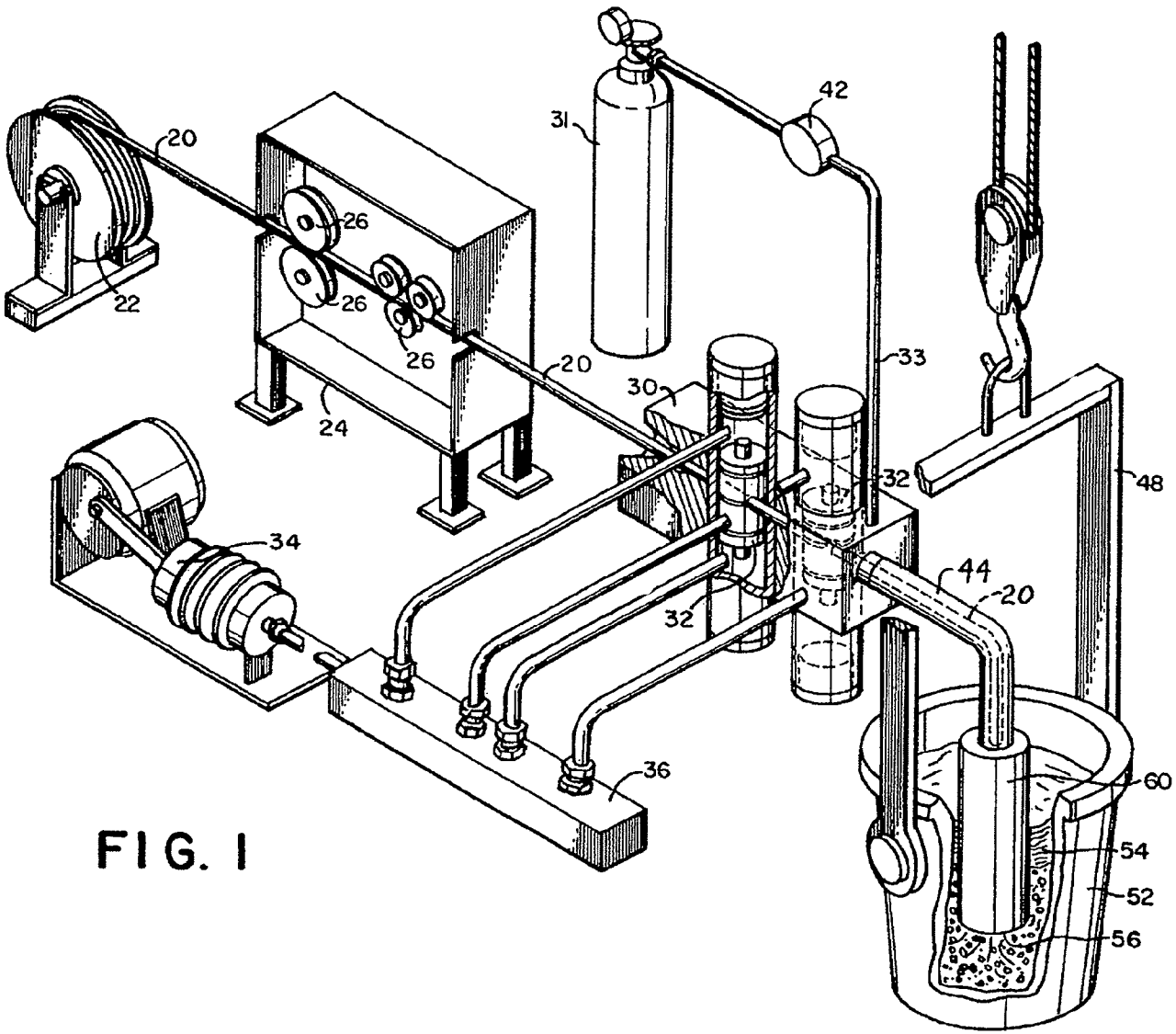
FIG. 1 is a perspective representation of a lance apparatus used for treatment of a quantity molten metal with additives in the form of a wire.

FIG. 1 shows a general view of a wire injection lance apparatus for treating a molten metal product using one or more processing elements provided in the form of a wire 20. A typical application for such apparatus is treating ferrous molten metal in a ladle with calcium containing wire. The wire 20 is conveyed from a reel 22 to the quantity of molten metal 56 in receptacle 52 (e.g. a ladle of ferrous molten metal). In order to accomplish such feeding, a feeding mechanism 24 draws the wire from the reel 22 and conveys the wire along a feed path. Adjacent the output portion, especially in the vicinity of a refractory lance 60, the wire 20 is carried in a gas-tight conduit 44. An inert gas is supplied to the gas-tight conduit, and a seal mechanism 30 located immediately upstream of the inert gas input prevents loss of inert gas around wire 20 in a direction backwards along the feed path. The conduit 44 extends into the lance 60 providing a passageway for the wire 20 through the lance 60.

A detailed description of a suitable wire feed mechanism 24 can be obtained from U.S. Pat. No. 4,235,362, the disclosure of which is incorporated herein by reference. A wide range of wire sizes and compositions are possible, including both sheathed and unsheathed wires. The wires, such as calcium containing wires, used for treating molten metals are generally of a dimension and composition that results in fairly stiff wire. Accordingly, the feed mechanism as well as the wire-carrying members must be capable of withstanding rough wear. Moreover, it should be expected that during feeding the relatively stiff wire will be prone to a certain amount of vibration and transverse displacement because of various discontinuities along the wire feed path and also because of bumps and bends that may be present in the wire.

Figure 2:
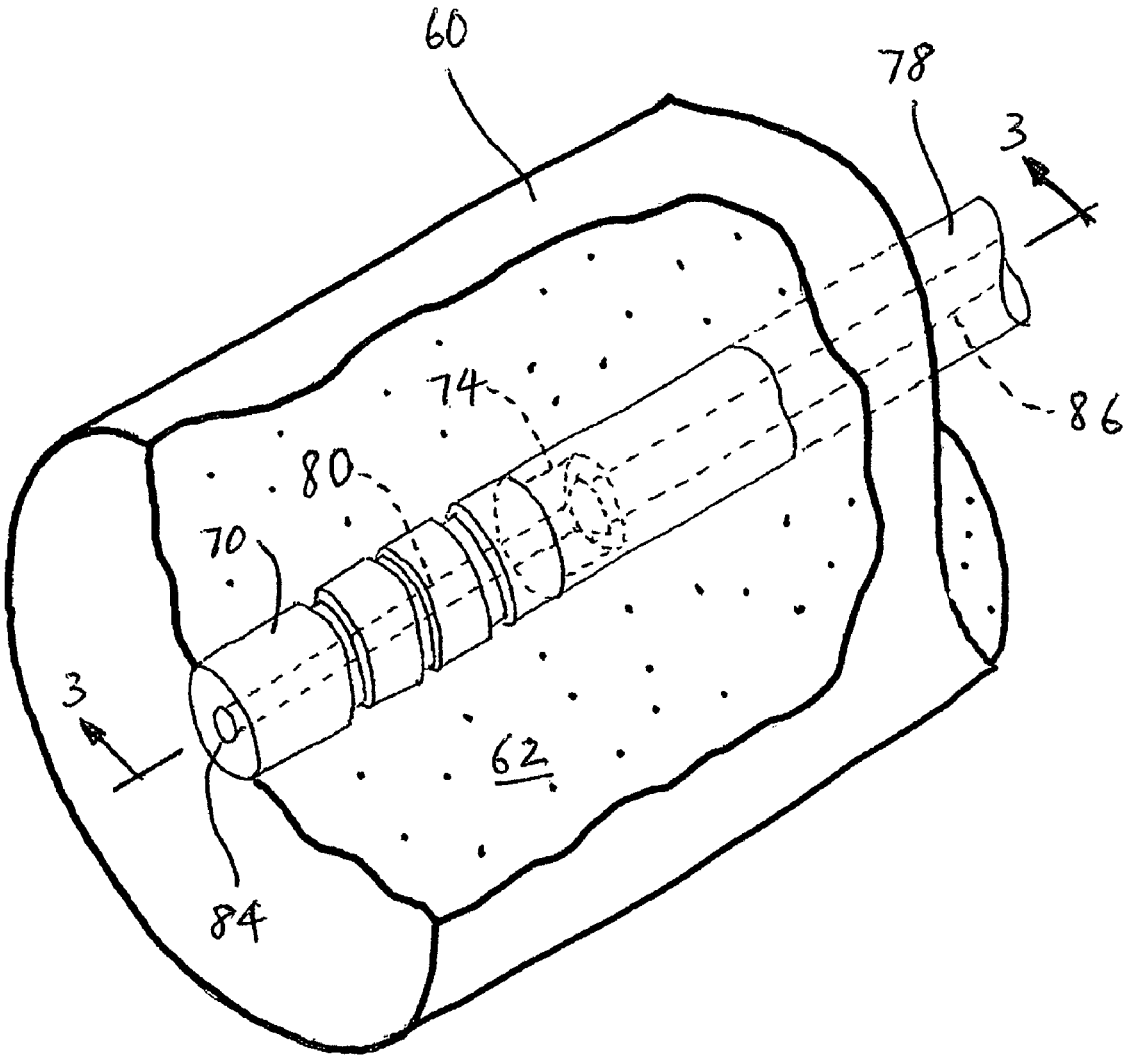
FIG. 2 is a perspective, partially cut-away, view of the lance of FIG. 1.

The lance 60 shown in detail in FIG. 2, according to an embodiment comprises a refractory ceramic casing 62 surrounding a conduit 78. The refractory casing portions 62 may be made of alumina silica refractory or any other suitable refractory material such as those used to line kilns and the like. The conduit 78 provides a passage 86 through which the wire 20 is conveyed and exit through an outlet 84. The outlet 84 is formed by a lance nozzle insert 70. The lance nozzle insert 70 has a passage 80 extending longitudinally therethrough and extends the passage 86 of the conduit 78 to the outlet 84.

Figure 3:
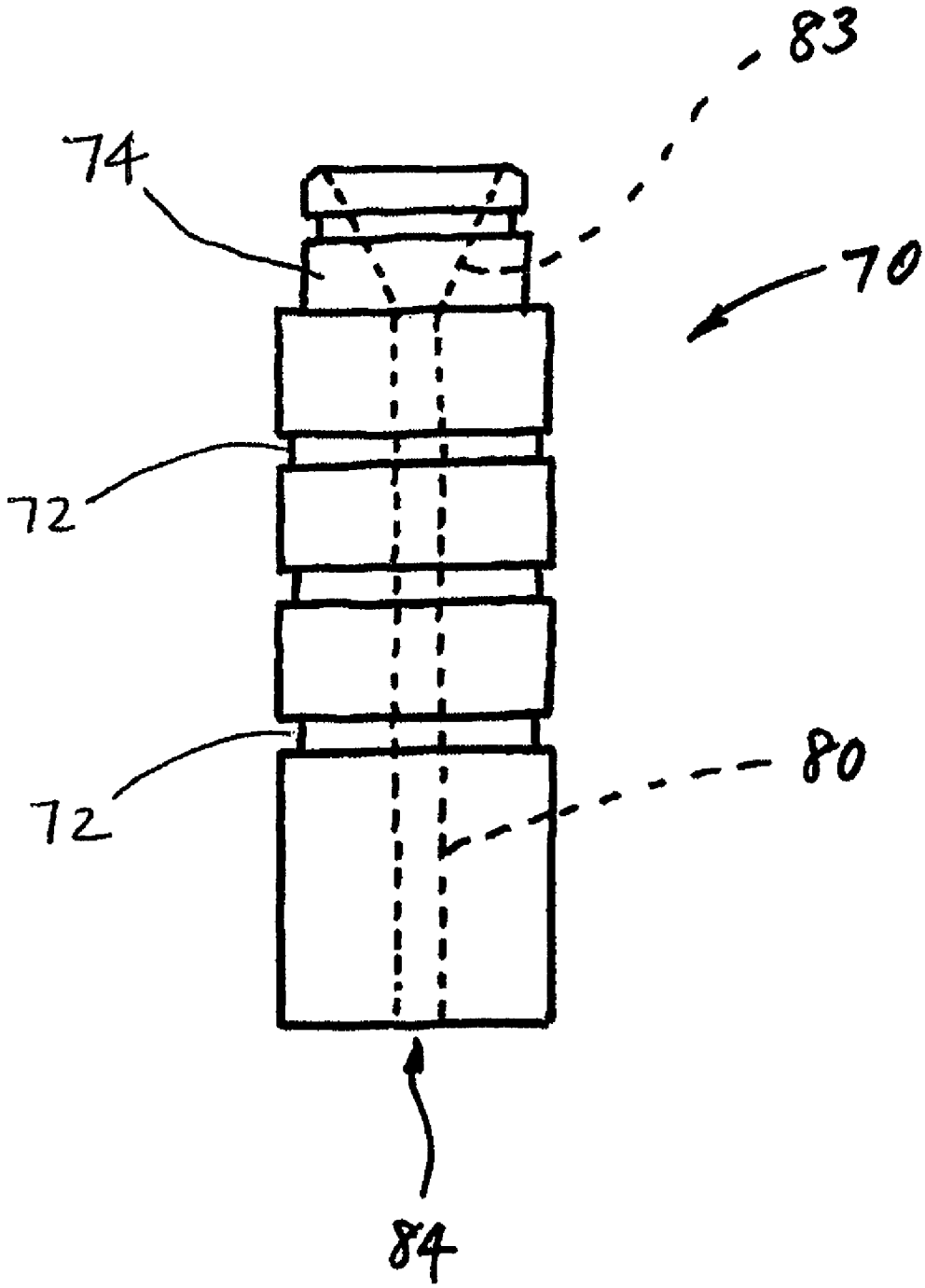
FIG. 3 is a side view of a lance nozzle insert provided in the lance of FIGS. 1 and 2.

FIG. 3 shows a detailed plan view of the lance nozzle insert 70 according to an embodiment. The lance nozzle insert 70 has a generally elongated shape with the passage 80 extending longitudinally therethrough for conveying the wire 20. The embodiment of the lance nozzle insert 70 as illustrated has a generally cylindrical outer shape but the insert does not need to be limited to such shape. For example, the lance nozzle insert may have a four-sided elongated shape or any other shape that is suitable for manufacture as long as it has the passage 80 therethrough for conveying the wire 20. One end of the passage 80 is the outlet 84 where the wire 20 exits into the molten metal. The opposite end of the lance nozzle insert 70 is configured and adapted to engage with the conduit 78. For example, in this example, the lance nozzle insert 70 is provided with a neck portion 74 at the inlet end which has a smaller outer diameter than the rest of the nozzle insert 70 for engaging into a recess 77 (shown in FIG. 4) of the conduit 78. The inlet 83 of the passage 80 flares out providing a funnel-shaped inlet. This enlarged opening enables the wire 20 to advance smoothly without kinks or jamming as the wire is transitioned from the conduit 78 portion to the lance nozzle insert 70. This is especially helpful at the initial feed of the wire 20 through the lance 60.

Figure 4:
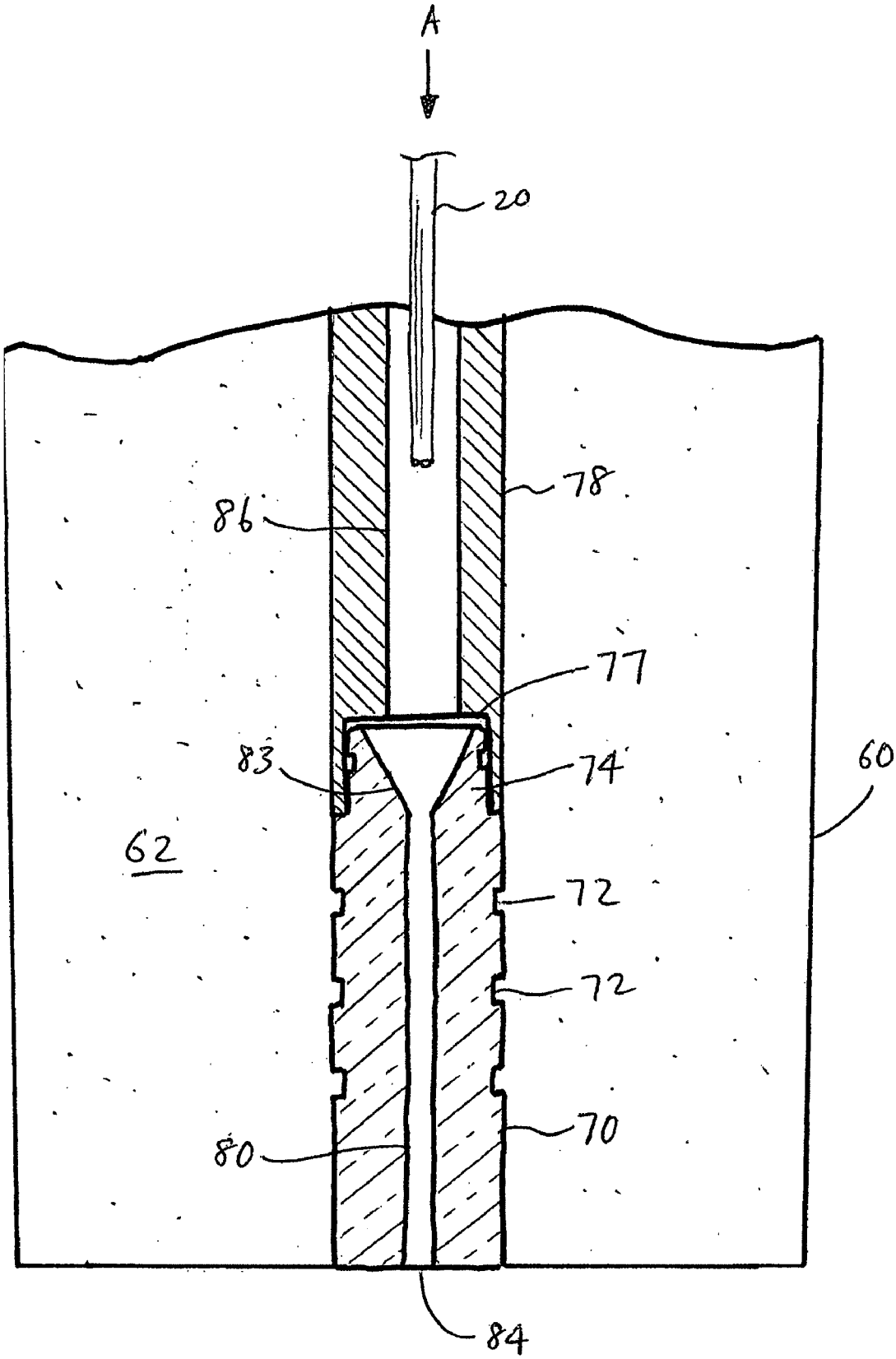
FIG. 4 is a cross-sectional view of the outlet end of the lance of FIG. 3 taken along line 3-3.

Referring to FIG. 4, a detailed cross-sectional view of the lance 60 of FIG. 2 taken through the line 3-3 will be discussed. The lance nozzle insert 70 and the conduit 78 are configured and adapted to engage one another in a suitable manner. For example, in the illustrated embodiment, the lance nozzle insert 70 has a neck portion 74 that engages the conduit 78 by fitting into the recess 77 provided at the end of the conduit 78. The lance nozzle insert 70 and the conduit 78 would be assembled together before they are encased in the refractory casing 62. Thus, the passage 86 of the conduit 78 and the passage 80 of the lance nozzle insert 70 provides a continuous passage way for the wire 20. The wire 20 advances in the direction of the arrow A shown. The diameter of the passage 80 in the lance nozzle insert 70 is generally much closer to the diameter of the wire 20 and smaller than the diameter of the passage 86 of the conduit 78. This arrangement in conjunction with the positive pressure of the inert gas being pumped through the conduit 78 prevents any of the molten metal from entering the passage 80 which could clog the lance.

The outer surface of the lance nozzle insert 70 is preferably provided with some contouring surface structure to promote mechanical locking of the nozzle insert with the refractory casing 62 surrounding the nozzle insert. In this embodiment, the lance nozzle insert 70 is provided with recessed channels 72 on the outer surface. The lance 60 is formed by casting or molding the refractory material around the conduit 78 and the lance nozzle insert 70 and the contoured surface of the lance nozzle insert 70 ensures that the nozzle tip is held securely within the refractory casing 62 by mechanical locking.

Figure 5:
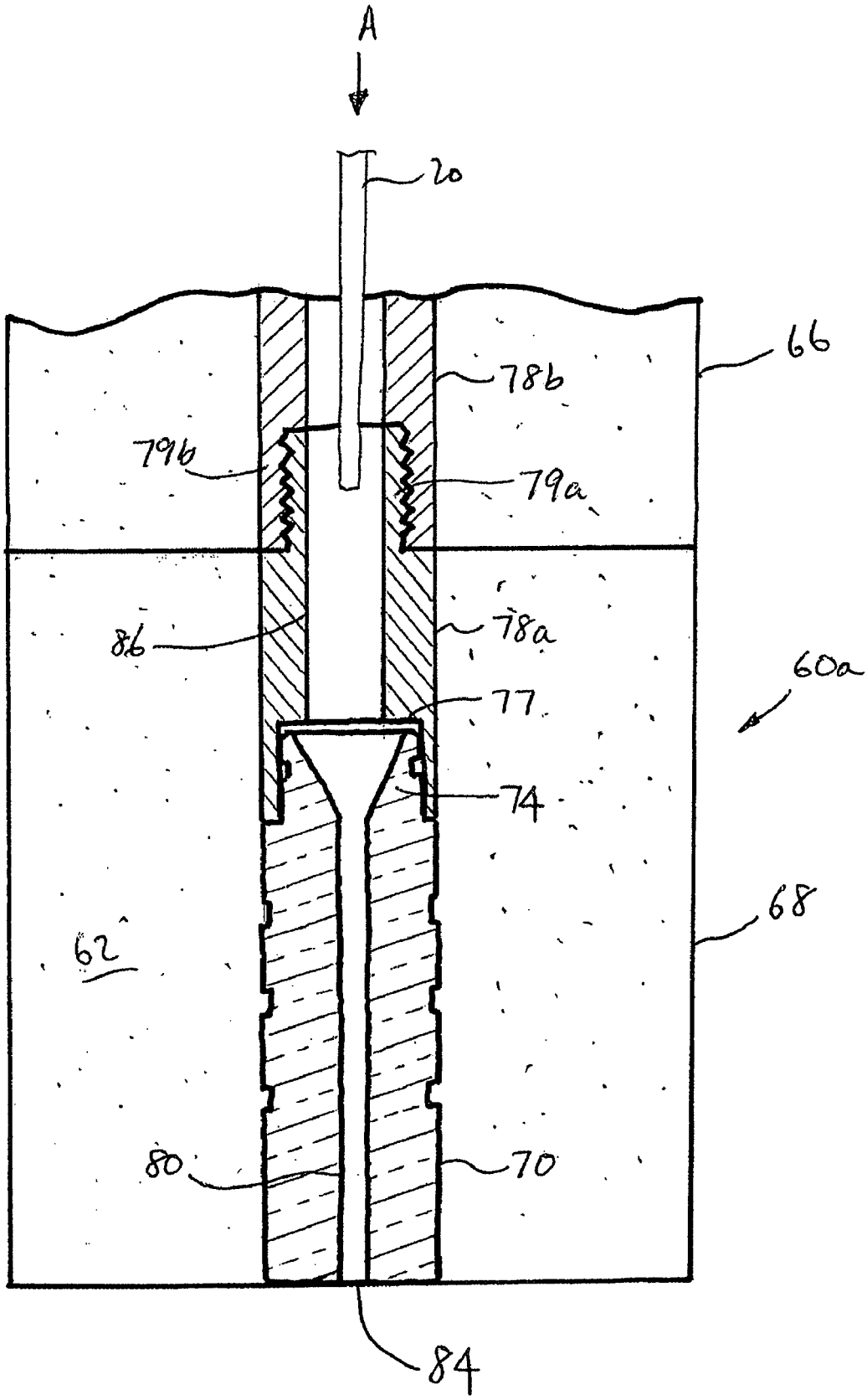
FIG. 5 is a cross-sectional view of the outlet end of another embodiment of the lance of FIG. 1.

Now referring to FIG. 5, another embodiment of the lance 60*a* is shown. In this embodiment, the lance 60*a* is provided in two pieces, a main portion 66 and a nozzle portion 68. The nozzle portion 68 has the lance nozzle insert 70 and a first conduit portion 78*a* provided therein and the main portion 66 has a second conduit portion 78*b* provided therein.

The lance nozzle insert 70 forms the outlet 84 at the terminal end of the nozzle portion 68 while the first conduit portion 78*a* forms an inlet end of the nozzle portion 68 that removably engages the main portion 66. The first conduit portion 78*a* is configured and adapted to engage the lance nozzle insert 70 at one end and configured and adapted to removably engage the second conduit portion 78*b* at the other end. The second conduit portion 78*b* is configured and adapted to engage the first conduit portion 78*a*. For example, the first conduit portion 78*a* may be provided with an extending threaded neck 79*a* and the second conduit portion 78*b* may be provided with a recessed portion 79*b* that is threaded to mate with the threaded neck 79*a*. Thus, the nozzle portion 68 and the main portion 66 of the lance are assembled together by threading the first conduit portion 78*a* and the second conduit portion 78*b* together. The first and second conduit portions 78*a*, 78*b* are preferably centered within the nozzle portion 68 and the main portion 66, respectively, as shown in FIG. 5 so that when the two lance portions are assembled together, they form a unitary lance nozzle 60*a*. The first and second conduit portions 78*a* and 78*b* form a passage 86 for the wire 20. This embodiment is useful where the lance nozzle insert 70 is exposed to a very corrosive environment and/or a lot of mechanical abrasion from the wire 20 which requires replacement of the lance nozzle insert 70 and or thermal shock of the refractory casing 62 due to subsequent steel dipping. In such situations, only the nozzle portion 68 of the lance 60*a* needs to be replaced rather than replacing the whole lance. This provides the user with much more economical technology.

The overall lance nozzle 60 is made long enough to extend to a preselected depth in the reservoir of molten metal. It is usually preferred that the wire additive be discharged from the nozzle about 2 to 8 feet below the slag/metal interface. Accordingly, with due regard to the high temperature and corrosive nature of the slag and metal, the refractory casing 62 is generally on the order of about 10 to 15 feet long.

The lance nozzle 60 may be raised and lowered with respect to the metal receptacle 52, or vice versa, by means of appropriate mechanical linkages. As shown schematically in FIG. 1, the metal receptacle 52 may be carried by a winch/conveying system, including yoke assembly 48. Alternatively, it may be preferable to raise and lower the entire feed mechanism as a unit. In any event, it is beneficial to avoid flexing the conduit 44.

In order to add the wire additive to the molten metal 56 at a point well below the surface of molten metal, it is necessary to overcome substantial fluid pressure in the molten metal. The fluid pressure is, of course, a function of the depth below the surface of molten metal. The particular pressure will depend upon the particular metal, but will usually be quite substantial at a depth of one or two meters. The pressure of inert gas supplied must overcome this fluid pressure in order to prevent molten metal 56 from rising in the nozzle. Should any molten metal be permitted to run into the nozzle, the wire 20 can immediately be seized and welded to a conduit wall as the molten metal solidifies.

According to an embodiment, to improve the useable life, i.e. the durability, of the lance nozzle insert 70, the lance nozzle insert is made from a new material that has higher oxidation resistance and slag corrosion resistance and at the same time still has a low friction surface to help feed the calcium wire through the lance nozzle insert at high speed. Higher resistance to oxidation and slag corrosion provides much longer useable life for the lance nozzle insert and thus necessitating much less frequent replacement of the nozzle insert during the life of the lance or may not even require any replacement.

The new material for the lance nozzle insert comprises stabilized zirconium oxide ($ZrO_2$), graphite and resin binder for holding the material together. The material comprises about 60 to 85 wt. percent of $ZrO_2$, about 10 to 36 wt. percent graphite and about 4 to 15 wt. percent resin binder. The material preferably comprises about 67 to 77 wt. percent of $ZrO_2$, about 19 to 29 wt. percent graphite and about 4 to 8 wt. percent resin binder. The $ZrO_2$ grains in the nozzle tip provide high corrosion resistance against the ladle slag in the ferrous molten metal. But $ZrO_2$ needs to be stabilized to avoid thermal spalling, caused by phase transformations due to subsequent thermal cycling. $ZrO_2$ can be stabilized with several oxides: CaO, MgO, $Y_2O_3$, or CeO. Typical ladle slag contains elevated lime concentrations and under these conditions, CaO is the preferred stabilizer because it is the thermodynamically most stable form of stabilized $ZrO_2$ for such environment.

The presence of graphite in combination with $ZrO_2$ in the new material increases the thermal shock resistance of the lance nozzle insert. The graphite component can be natural graphite or synthetic graphite. However, natural flake graphite (amorphous graphite being other common form of natural graphite) is preferred because of natural flake graphite's high oxidation resistance, which increases the nozzle insert's oxidation resistance properties. The corrosion resistance of the $ZrO_2$/graphite blend is significantly higher compared to the current lance nozzle inserts which are made from pure carbon.

Because $ZrO_2$ grains are very hard and have sharp edges, a fine grain size distribution (−325 Mesh, i.e. less than 44 μm particle size) is preferred to minimize mechanical friction and wear properties of $ZrO_2$. If the grain size distribution is not controlled to such fine size, excessive mechanical wear at the inner bore of the lance nozzle insert 70 may be observed from the wire feeding through the nozzle insert, which would shorten the life of the lance nozzle insert.

The fabrication process for the lance nozzle insert involves blending $ZrO_2$ powder and graphite. Then, resin binder in the amount specified above is added to the blend to form a plastic mixture, hereafter referred to as a slurry. The resin binder is preferably a thermosetting binder material that is added in a combination of liquid and solid powder form. Both the powder and the liquid resins are phenol-formaldehyde polymer resin. The powder resin can be classified as novolak while the liquid resin can be classified as resole. The powder resin and liquid resin is provided in a powder/liquid wt. percent ratio of about 60/40 to about 40/60 and preferably about 50/50. The slurry is continuously mixed until the temperature of the slurry reaches 140° F. The temperature of the slurry rises during the mixing process because of the internal friction of the slurry material from the mechanical mixing action. At this stage, the blended slurry comprises globules of the mixed material bound by the liquid resin. Generally, because the amount of liquid resin added to enable homogeneous blending of the material is more than optimal for the next molding step, the slurry is then dried in a rotating furnace. The drying step is engineered in terms of the temperature and time duration to produce a slurry having the desired moisture content for the molding step. The dried slurry is then molded into a desired shape for the lance nozzle insert and thermally treated.

One of the advantages of using organic resin over water to form the slurry is that water will evaporate during subsequent thermal processing steps leaving behind pores and resulting in unacceptably high porosity in the lance nozzle insert 70. On the other hand, organic resin gets partially burned off during subsequent thermal processing steps and leaves behind carbon residue. This residual carbon material promotes lower porosity and enhances the properties of the nozzle insert. Higher porosity is not desired because pores promote the corrosion mechanism that attacks the nozzle insert when immersed in the molten metal.

Pure zirconia, although having better corrosion resistance than pure carbon, currently used for lance nozzle insert, is not suitable because of its poor thermal shock resistance attributable to its monoclinic tetragonal crystal structure. Stabilized $ZrO_2$, however, having a cubic crystal structure has better thermal shock resistance and, thus, is better suited for lance nozzle insert application. Both the thermal shock resistance and the surface abrasion (i.e. friction) properties are further improved by blending the $ZrO_2$ with graphite resulting in more durable lance nozzle inserts. Test results show about 2 to 20 times improvement in the useable life of the $ZrO_2$-based lance nozzle inserts compared to the lance nozzle inserts made from conventional pure carbon.

The molding process for forming the pre-dried slurry into the lance nozzle insert can be any one of a variety of molding processes available that would work for this particular blend of material and the final shape of the insert. An example of such molding process is isostatic molding. Isostatic molding is a process where molding pressures are applied evenly in all directions around the part being made, unlike in compression molding which has pressure applied in only one direction. An isostatically molded part is made to near net shape and thus significantly less waste material is generated compared to other molding techniques. Isostatically molded parts generally have highly consistent material properties. Isostatic molding applies the pressure on the mold by placing the mold inside a high pressure vessel filled with hydraulic fluid. The hydraulic pressure of 5,000 to 20,000 psi and even higher may be used. Such high isostatic pressure produces lower porosity and more favorable pore size distribution of the molded part.

Next, the isostatically molded lance nozzle insert is cured at about 180° C. to volatilize the organic vapors from the polymer resin. Then, the lance nozzle insert is fired preferably at about 800 to 1200° C. in reducing atmosphere. If necessary, the lance nozzle insert may be further machined to print dimensions.

As the wire 20 is fed, it can be expected to vibrate and rattle around the allowed space within the passage 80. However, the wire generally remains centrally positioned in the discharge passage 80 even if resting against a side wall of the passage 80. The space which is left open between the wire 20 and the side wall of the passage 80 is small enough that the gas pressure overcomes the fluid pressure of displaced molten metal, otherwise tending to flow up the nozzle. Interactive movement of the wire and the inert gas enhance the ability of the nozzle to resist clogging.

The seal mechanism 30 is provided in the wire feeding system to prevent a backwash of inert gas. Seal mechanism 30 comprises a housing having at least one pair of opposed pistons 32 having contoured sealing surfaces for slidably engaging the wire moving therebetween, which clasp the advancing additive wire 20 in a gas-tight fashion. Downstream of the opposed pistons 32, the inert gas is fed from inert gas source 31 via conduit 33 to the area of the wire 20, the wire now being enclosed in a gas-tight conduit 44 leading from seal 30 to the lance 60. A compressed air source 34 is preferably used to drive opposed pistons 32 against the wire 20. Spring biasing, hydraulic pressure or the like are also possible. A manifold 36 may be used to equally distribute the air pressure of compressor 34 or other source. The particulars of the seal mechanism 30 are disclosed in U.S. Pat. No. 4,512,800, assigned to the applicant, the disclosure of which is incorporated herein by reference.

A suitable control mechanism may be connected simultaneously to the pinch roller wire feed device 24 and to the inert gas pressure control 42. To avoid waste, the gas control 42 should be left closed until the wire becomes engaged by opposed pistons 32 of seal 30. In any event, no particular gas pressure is required until the wire injector lance 60 is brought into proximity with the molten metal 56, or the slag 54 thereupon. At this point, the feeder and inert gas pressure control may be simultaneously activated, and the nozzle plunged into the molten metal. Melting additive and inert gas are discharged at the nozzle orifice, well below the slag/metal interface.

The essential features of the invention having been disclosed, further variations will now become apparent to persons skilled in the art. All such variations are considered to be within the scope of the appended claims. Reference should be made to the appended claims, rather than the foregoing specification, as indicating the true scope of the subject invention.

What is claimed is:

1. A wire injection lance apparatus for treating a molten metal product using an additive wire, the wire injection lance apparatus comprising:

a wire feeding mechanism for conveying the wire to a lance wherein the lance feeds the wire into a quantity of the molten metal below the surface of the molten metal;

the lance comprising:

a refractory casing having an outlet;

a conduit located within the refractory casing providing a passage for conveying the wire to the outlet; and a lance nozzle insert provided within the refractory casing in communication with the conduit and forming the outlet, wherein the lance nozzle insert is made from material comprising 60 to 85 wt. percent stabilized zirconium oxide having a particle size distribution of less than 325 mesh and 10 to 36 wt. percent graphite and 4.0 to 15 wt. percent of a thermosetting resin binder.

2. The wire injection lance apparatus of claim 1, wherein the graphite is natural graphite.

3. The wire injection lance apparatus of claim 2, wherein the graphite is natural flake graphite.

4. The wire injection lance apparatus of claim 1, wherein the graphite is synthetic graphite.

5. The wire injection lance apparatus of claim 1, wherein the material for the lance nozzle insert comprises about 67 to 77 wt. percent stabilized zirconium oxide, about 19 to 29 wt. percent graphite and about 4 to 8 wt. percent thermosetting resin binder.

6. The wire injection lance apparatus of claim 1, wherein the zirconium oxide is stabilized with an oxide selected from the group consisting of CaO, MgO, $Y_2O_3$, and CeO.

7. The wire injection lance apparatus of claim 1, wherein the refractory casing comprises:

a nozzle portion having the lance nozzle insert and a first portion of the conduit provided therein; and a main portion having a second portion of the conduit provided therein, wherein the first and second portions of the conduit engage to form the passage for conveying the wire to the outlet.

8. The wire injection lance apparatus of claim 7, wherein the main portion and the nozzle portion are adapted and configured to removably engage each other allowing the nozzle portion to be replaced.

9. The wire injection lance apparatus of claim 8, wherein the first and second conduit portions are provided with mating threads and the main portion and the nozzle portion of the refractory casing threadably engage each other by operation of the mating threads.

10. The wire injection lance apparatus of claim 1 wherein the lance nozzle insert is made by molding.

11. The wire injection lance apparatus of claim 1 wherein the lance nozzle insert is made by isostatic molding.

* * * * *